United States Patent [19]

Green

[11] Patent Number: 5,016,658

[45] Date of Patent: May 21, 1991

[54] MAKEUP SHIELD FOR LEFT AND RIGHT EYELASHES

[76] Inventor: Kathrine W. Green, 6803 Harbor View Way, Tampa, Fla. 33615

[21] Appl. No.: 516,795

[22] Filed: Apr. 30, 1990

[51] Int. Cl.[5] ..... A45D 40/30

[52] U.S. Cl. ..... 132/216; 132/319

[58] Field of Search ..... 132/216, 319, 320, 218

[56] References Cited

U.S. PATENT DOCUMENTS

| | | | |
|---|---|---|---|
| D. 119,329 | 3/1940 | Leyne | 132/216 |
| 1,850,540 | 3/1932 | Erickson | 132/216 |
| 1,873,928 | 8/1932 | Bohner | 132/216 |
| 1,907,476 | 3/1933 | Ballard et al. | 132/218 |
| 1,974,825 | 9/1934 | Lovie | 132/218 |
| 2,260,614 | 10/1941 | Freitas | 132/216 |
| 3,789,856 | 2/1974 | Bomba | 132/319 |
| 4,033,364 | 7/1977 | Inzana et al. | 132/216 |

FOREIGN PATENT DOCUMENTS

| | | | |
|---|---|---|---|
| 111143 | 7/1944 | Sweden | 132/319 |

*Primary Examiner*—Paul J. Hirsch

[57] ABSTRACT

The present invention provides a device which may be used during the application of eyelash makeup. The device consists of a body with each end conforming generally to the slanted curvature of the left and right human eyes and facial bone structures, with the connecting handle fastened to each end of an offset angle which results in a comfortable fit to the respective left or right eye. The handle fits in place between the nose bridge and cheekbone with the upper end of the body formed with a curvature so as to fit around the underside and outside of the lower eyelash of the user.

4 Claims, 1 Drawing Sheet

FIG_2_
FIG_1_
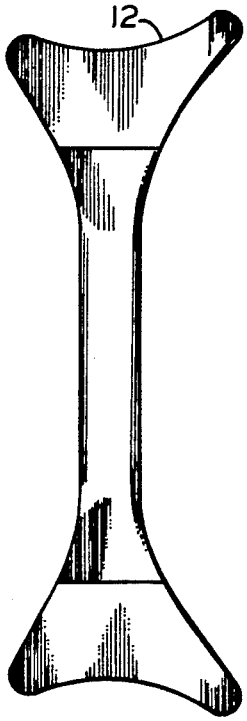
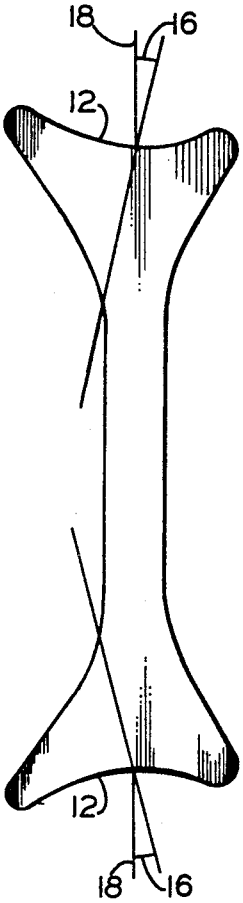
FIG_3_
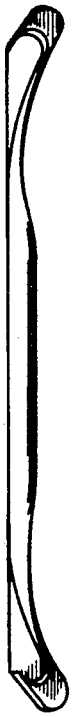
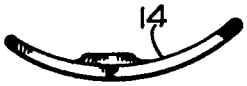
FIG_4_
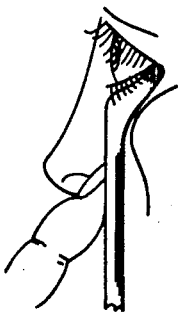
FIG_5_
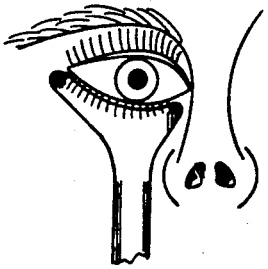
FIG_6_

MAKEUP SHIELD FOR LEFT AND RIGHT EYELASHES

FIELD OF THE INVENTION

This invention relates to devices for use in the application of eye makeup. In particular, this invention relates to a device which is particularly suitable for use in the application of makeup to the individual left and right side lower eyelashes.

PRIOR ART

Numerous devices have previously been made for use as shields and the like when applying eye makeup such as mascara. Typical examples of these known devices are found in U.S. Pat. No. 1,974,825 dated Sept. 25, 1934 and issued to Lovie; U.S. Pat. No. D 119.329 dated Mar. 5, 1940 and issued to Leyne; and U.S. Pat. No. 3,789,856 dated Feb. 5, 1974 and issued to Bomba. A major problem of the first two devices referenced above is that they provide a sharp edge which is contoured to the curvature of the eyeball which is directed inwardly towards the eyeball in use, causing considerable discomfort to the user if the device is not held stationary in exactly correct positions. The third device referenced above has a turned edge somewhat different from earlier models to provide more safety, but the problem remains that the devices are awkward to handle and must be held at different angles toward the eyeball as the user applies makeup to various portions of the lower eyelash. Awkwardness and discomfort is encountered during use with all of the above because the devices must be held at one angle while applying makeup to the eyelash near the user's nose, and the devices must be held at different angles over the upper cheekbone (the lower protruding skeletal portion of the eyesocket) as the user applies makeup to the center or outer sections pf the lower eyelash. Moving the tool at various angles increases the potential for eye injury or irritation while also distracting the user from properly applying eyelash makeup with the other hand. The common reason for all problems reflected above is that the devices are all generically made to fit both left or right eyelids without providing for the upper cheekbone which is an obstacle at opposite angles for the left or right side of the user's face. This invention features a curvature conforming generally to fit under the lower eyelash; a slanted inner curvature conforming generally to fit around the lower eyelid and left or right upper cheekbone; and a handle to the device positioned at an offset angle to fit flat against the user's face between the nose and upper cheekbone. By providing the slanted cheekbone curvature and offset handle angle for individual left and right facial curvatures, the device will fit comfortably in place below and around the entire lower eyelash by pressing the device flat against the user's face with only one finger. To minimize cost and maximize convenience, the devices to fit the left and right sides may be molded on opposite ends of the same instrument. As a result of using this invention, mascara or other lower eyelash makeup may be applied more easily, comfortable, safely, quickly and consistantly, while reducing the probability of eye irratation or eyelash makeup smudge.

SUMMARY

This invention overcomes difficulties of prior art described above by providing a device featuring dual slanted curvatures conforming generally to the shape of the user's lower eyelid and upper cheekbone for both left and right sides of the face with a handle at the center connected to each end at an angle offset from the slanted curvatures. The device may be pressed against either the left or right side of the user's face and, without any additional movement, comfortably cover the entire lower eyelid from the nose bridge to outer side of the eye to enhance speed, safety and quality of eye makeup application.

DRAWINGS

The invention will be more clearly understood with reference to the following detailed specifications read in conjunction with the drawings wherein:

FIG. 1 is a front view of the device according to an embodiment of the present invention.

FIG. 2 is a pictorial rear view of the device of the present invention.

FIG. 3 is a pictorial side view of the device of the present invention.

FIG. 4 is a pictorial top view of the device of the present invention.

FIG. 5 is a side view illustrating the manner in which the device is used on the left eye, and FIG. 6 is a front view illustrating the manner in which the device is used on the right eye.

PREFERRED EMBODIMENT

With reference to FIG. 1 of the drawings, the reference numeral 10 refers generally to a device for use in the application of eye makeup according to an embodiment of the present invention. The device is preferably formed from a unitary body plastic material. The selection of the material from which the device is to be molded will be obvious to those skilled in the art.

As shown in FIGS. 1 and 2 of the drawings the radius of arc 12 measures approximately three centimeters. The purpose of arc 12 is to fit under the lower eyelash. As shown in FIG. 4 of the drawings, the radius of arc 14 measure approximately two and one-half centimeters. The purpose of arc 14 is to fit around the curvature of the lower eyelid and upper cheekbone. As shown in FIG. 2 of the drawings, angle 16 measures approximately fifteen degrees. In FIGS. 1, 2 and 4, arcs 12 and 14 and angle 16 measurements may vary according to people users of various sizes and/or ethnic origin. Angle 16 measures the degree of offset of arc 14 to handle centerline 18. The contours of arc 12 and arc 14 as well as the corners and edges of the tool may be generally shaped in order to fit facial contours of anticipated users of the device. As shown in FIGS. 5 and 6 of the drawings, the device is used by positoning the device 10 over and around the left or right lower eyelid, beneath the eyelash, conforming to the curvature of the user's face with device handle pressed against the user's face vertically between the nose bridge and cheekbone. While holding the device 10 in place, makeup may be applied to the entire lower eyelash without any further positioning of device 10.

Various modifications of the present invention will be apparent to those skilled in the art without departing from the scope of this invention. For example, arc circumference and angles may be more or less rounded or tapered; wall thicknesses may vary; and the handle or ends may be narrowed, widened, curved, lengthened or shortened.

From the aforegoing, it will be apparent that the present invention provides a simple amd inexpensive device that is a new and useful improvement over previous devices for use in the application of lower eyelash makeup.

What I claim for my invention is:

1. A device for use in the application of eyelash makeup comprising: a narrow elongated handle having a first end and second end; a pair of shields, said first shield attached to said first handle end and said second shield attached to said second handle end; said first shield having a dual radius conforming generally to the shape of user's left lower eyelid; said first shield also curving down and returning inwardly under on both sides, reducing to the width of said handle in such curvatures as required to shape sides of the shield and handle over, around and between facial bone structures of the nose and cheek of the left side of the user's face; said second shield shaped identically to said first shield, except that all curvatures and shapes are in a reverse fashion so as to fit the right side of the user's face; said shield attached to each end of said handle at offset angles causing the respective left or right shields to fit safely and comfortably over the left or right lower eyelids when the device handle is pressed vertically against the user's face; whereby the user may comfortably and safely shield the left or right lower eyelids during lower eyelash makeup applications by pressing the device against the face using only one finger.

2. A device as described in claim 1, wherein: said first and second shields are attached to each end of said handle at an offset in such a way that the center line of said handle is closer to inside shield corners than to outside shield corners; said inside shield corners being the corners positioned closest to the user's nose; said outside shield corners positioned closest to the user's cheek; whereby said offset to the device handle causes said handle to conform generally to fit flat against the user's face in a vertical position with the handle resting over the skull indentation between the nose and cheek bones to improve comfort and eliminate motion of the device during use.

3. A device as described in claims 2, wherein: said shields are attached to said handle ends at offset angles of approximately fifteen degrees; whereby said outside corners of said shields curve higher around the lower eyelashes than said inside corners for an improved custom fit specifically for the individual left and right lower eyelids, eliminating the need to rotate or move the device around the eyelashes during application of makeup.

4. A device as described in claim 1, whereby the word "left" is imprinted on the surface of said first shield and the word "right" is imprinted on the surface of said second shield to improve user convenience and safety.

* * * * *